US007401621B2

(12) United States Patent
McCann

(10) Patent No.: US 7,401,621 B2
(45) Date of Patent: Jul. 22, 2008

(54) DISPENSER SUMP

(75) Inventor: Michael T. McCann, Florence, KY (US)

(73) Assignee: Pisces By OPW, Inc., Hamilton, OH (US)

( * ) Notice: Subject to any disclaimer, the term of this patent is extended or adjusted under 35 U.S.C. 154(b) by 620 days.

(21) Appl. No.: 11/091,222

(22) Filed: Mar. 28, 2005

(65) Prior Publication Data

US 2005/0252932 A1 Nov. 17, 2005

Related U.S. Application Data

(60) Provisional application No. 60/571,295, filed on May 15, 2004.

(51) Int. Cl.
*D06F 39/08* (2006.01)
*B65B 1/04* (2006.01)
*E02B 13/00* (2006.01)

(52) U.S. Cl. ..... 137/312; 137/560; 141/86; 405/52; 220/484

(58) Field of Classification Search ..... 222/108, 222/111, 109, 385, 377; 137/312, 560; 405/52; 220/484
See application file for complete search history.

(56) References Cited

U.S. PATENT DOCUMENTS 4,921,115 A * 5/1990 Fields, III ..... 405/55
4,989,634 A * 2/1991 Rieseck ..... 137/363
5,098,221 A 3/1992 Osborne
5,167,470 A 12/1992 Bertolozzi et al.
5,301,722 A 4/1994 Todd et al.
5,550,532 A 8/1996 Marshall
5,819,975 A * 10/1998 Pendleton et al. ..... 220/484
6,039,201 A 3/2000 Kesterman et al.
6,099,202 A 8/2000 Walton et al.
6,123,365 A 9/2000 Lamping
6,182,679 B1 2/2001 Pendleton
6,224,115 B1 5/2001 Blasch et al.
6,371,154 B1 4/2002 Kesterman et al.
6,375,384 B1 4/2002 Walton et al.
6,454,237 B1 9/2002 VanDeVyvere et al.
6,516,706 B2 2/2003 Porter et al.
6,523,581 B2 2/2003 Pendleton et al.
6,538,261 B1 3/2003 McConnel et al.
6,729,797 B2 5/2004 Manger et al.
6,834,892 B2 12/2004 Kornau et al.

* cited by examiner

*Primary Examiner*—Kevin P. Shaver
*Assistant Examiner*—Stephanie E Tyler
(74) *Attorney, Agent, or Firm*—Dinsmore & Shohl LLP

(57) ABSTRACT

A sump for a dispensing unit is disposed beneath the footprint of the dispensing unit and includes an auxiliary communication line receiving structure proximal to a drip area of the dispensing unit. The auxiliary communication line receiving structure delivers electrical and/or other communication line (s) to the dispensing unit from beneath the dispensing unit footprint without creating a potential leak path into or out of the sump.

11 Claims, 8 Drawing Sheets

DISPENSER SUMP

RELATED APPLICATION

The present application claims priority of U.S. Provisional Application Ser. No. 60/571,295 filed May 15, 2004 and hereby incorporates the same Provisional Application by reference.

FIELD OF THE INVENTION

The present invention is generally directed to sumps and more specifically to a sump for collecting drippage from a liquid dispensing component. The invention will be specifically disclosed in connection with a sump having a passageway for directing electrical lines or other auxiliary communication lines to a drip area beneath a liquid fuel dispenser, such as a fuel dispenser of the type commonly used for dispensing fuel at a gasoline station or the like.

BACKGROUND OF THE INVENTION

In a typical automotive fueling station, fuel is delivered to an above-ground dispensing pump through a network of underground tanks, pipes, fittings, sumps and dispensers. The sumps used in these networks include sumps located beneath the above-ground dispensing units. These sumps preferably fit fully beneath the housings for the above-ground dispensing units and function to prevent ground contamination from any drippage of components in the above-ground dispensing units.

In order to reduce the risk of soil contamination, it is desirable, if not imperative, for sumps located beneath the above-ground dispensing units to receive any and all fuel that may leak or drip from the dispensing units. For this reason, the openings of such sumps are large enough to completely cover the potential drip area beneath the dispensing units. It also is economically desirable to avoid making the sumps too large. Thus, it is common to have properly designed sumps with openings that are sized and shaped to match the footprint of the dispensing unit housing, i.e., the size and shape of the opening of the sump are sized and shaped to correspond to the area where drippage may occur.

It also is desirable to supply components in above-ground dispensing units with electrical power from beneath the units. This has been achieved in the prior art by passing electrical conduits through the sidewalls of the sumps, and directing the electrical conduits out of the sump through the top opening used to collect drippage. While this practice has the advantage of directing the electrical or other auxiliary communication lines to the dispensing unit under the housing, the passage of the communications lines through the wall of the sump creates a potential leak path, such as by leakage of collected fuel out of the sump and/or leakage of groundwater into the sump. This problem has been partially alleviated through the use of seals at the entry location for such lines into the sump. Nevertheless, the installation and use of such seals adds to cost. Furthermore, such seals are prone to deterioration over time, and leakage sometimes occurs despite the use of high quality seals.

SUMMARY OF THE INVENTION

Accordingly, it is an aspect of the present invention to provide a sump that overcomes the deficiencies of the prior art. Specifically, it is an aspect of the present invention to provide a sump that collects all drippage from a fluid component while, at the same time, permits auxiliary communication lines to be directed beneath a predetermined footprint without introducing a potential leak path into or out of the sump.

Additional aspects, advantages and novel features of the invention will be set forth in the description that follows and in part will become apparent to those skilled in the art upon examining or practicing the invention. The aspects and advantages of the invention may be realized and attained by means of the instrumentalities and combinations particularly pointed out in the appended claims.

To achieve the foregoing and other aspects, and in accordance with the purposes of the present invention described herein, a dispenser sump adapted for placement beneath a fluid handling component is provided. The sump includes a containment structure having a bottom wall structure and at least one sidewall structure. The bottom and the at least one sidewall structures cooperate to define an internal cavity within the containment structure that is capable of holding a fluid. The sidewall structure further defines a drip opening opposite the bottom wall structure. The drip opening defines a predetermined drip area for receiving fluid drippage and is adapted for placement beneath a footprint of a fluid handling component. A passageway extends into a space defined by the containment structure and exits adjacent to the drip area defined by the opening. The passageway is isolated from the internal cavity and is adapted to receive and direct auxiliary communications lines beneath the footprint of a fluid handling component.

According to one specific form of the invention, the passageway is formed by a recess in the sidewall of the containment structure that extends vertically from a position below the drip opening into the drip opening.

In another form of the invention, the recess forming the passageway includes a vertically extending open side extending to the exterior of the containment structure.

Another specific form of the invention involves the recess extending into the drip area, wherein both the recess and the drip area each have generally quadrilateral configurations.

In one specific form of the invention, the passageway extends vertically from the bottom wall structure to a position adjacent to the drip opening.

In another specific form of the invention, the predetermined drip area has a generally rectangular configuration.

In one preferred form of the invention, the recess in the sidewall forming the passageway includes an opening to the exterior of the containment structure.

In another specific form of the invention, the passageway extends from a position adjacent to the opening but does not extend to the bottom wall structure.

Still another form of the invention includes a dispenser assembly comprising a liquid fluid dispenser and a dispenser sump. The liquid fluid dispenser includes a housing having an interior area and a footprint with a predetermined size and configuration. At least one liquid dispenser component is disposed within the interior area of the housing. The dispensing sump is disposed beneath the housing and includes a containment structure. The containment structure includes a bottom wall structure and at least one sidewall structure. The bottom and the at least one sidewall structures cooperate to define an internal cavity within the containment structure capable of holding a fluid. The at least one sidewall structure further defines a drip opening opposite the bottom wall structure. The drip opening defines a drip area sized and configured to correspond to the footprint of the housing. The drip opening is disposed beneath the housing footprint and is operative to receive drippage from the at least one liquid dispenser component. A passageway extends into a space defined by the containment structure and exits adjacent to the drip area defined by the opening. The passageway is isolated from the internal cavity of the containment structure. At least one auxiliary communication line extends through the passageway and exits the containment structure and extends from beneath the footprint of the housing to the at least one liquid dispenser component.

In another form of the invention, the passageway is formed by a recess in at least one sidewall of the containment structure that extends vertically from a position below the drip opening into the drip opening.

In another form of the invention, the recess forming the passageway includes a vertically extending open side extending to the exterior of the containment structure.

According to one preferred form of the invention, the footprint of the housing and the opening defining the drip area have matching quadrilateral configurations and sizes.

In one specifically preferred form of the invention, the drip area and the recess extending into the drip area each have generally rectangular configurations.

In one specific form of the invention, the passageway extends vertically from the bottom wall structure to a position adjacent to the opening.

In another specific form of the invention, the passageway may be formed by a recess in the sidewall of the containment structure and may extend into the drip area.

In one specific form of the invention, the passageway includes an opening to the exterior of the containment structure.

In one alternative form of the invention, the passageway extends from a position adjacent to the opening but does not extend to the bottom wall structure.

In yet another form of the invention, a dispenser sump adapted to accommodate auxiliary communication lines is provided. The dispenser sump includes a containment structure with a bottom wall structure and at least one sidewall structure. The bottom and the at least one sidewall structures cooperate to define an internal cavity within the containment structure capable of holding a fluid. The sidewall structure further defines a drip opening opposite the bottom wall structure. The drip opening defines a predetermined drip area for receiving fluid drippage and is adapted for placement beneath a footprint of a fluid handling component. An auxiliary communication line receiving structure is disposed proximal to the drip opening. The receiving structure is adapted to receive an auxiliary communication line located external to the containment structure and to direct an auxiliary communication line to a position adjacent to the drip area.

BRIEF DESCRIPTION OF THE DRAWINGS

The following detailed description will be more fully understood in view of the drawing in which.

Figure 1:
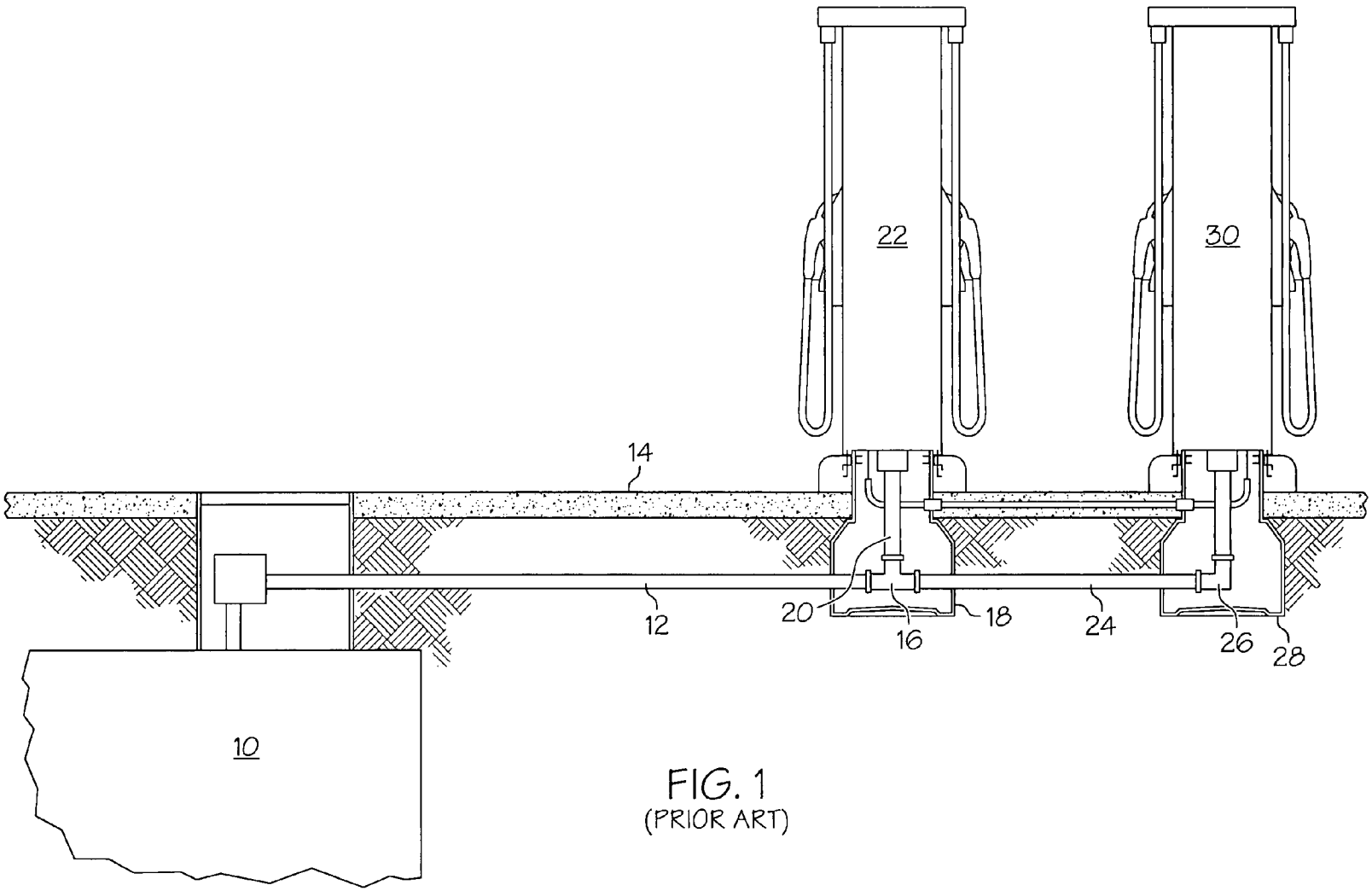
FIG. 1 (PRIOR ART)
FIG. 1 is a schematic representation of a prior art fluid dispensing network for a typical fuel dispensing station depicting various components of the network for dispensing fuel from an underground storage tank to an above-ground dispenser.

The embodiments set forth in the drawings are illustrative in nature and are not intended to be limiting of the invention defined by the claims. Moreover, individual features of the drawings and the invention will be more fully apparent and understood in view of the detailed description provided herein.

DETAILED DESCRIPTION OF EXEMPLARY EMBODIMENTS

Referring now to the drawings, and to FIG. 1 in particular, a prior art networking of fluid dispensing components of the type typically found in a fuel dispensing station is shown. The network includes an underground storage tank 10 from which gasoline or other fuel is pumped and delivered to a fuel delivery pipe 12. As depicted in FIG. 1, the fuel delivery pipe 12 is disposed in an underground position beneath a drive surface 14 of the dispensing station. The fuel delivery pipe 12 terminates in a T-fitting 16 disposed within an underground sump 18. The T-fitting 16 directs the flow of fuel from the underground storage tank 10 to a riser pipe 20 beneath an above-ground dispensing unit 22, and to a further delivery pipe 24. The delivery pipe 24 directs fuel to a fitting 26 disposed within a sump 28 beneath a further above-ground dispensing unit 30.

Figure 2:
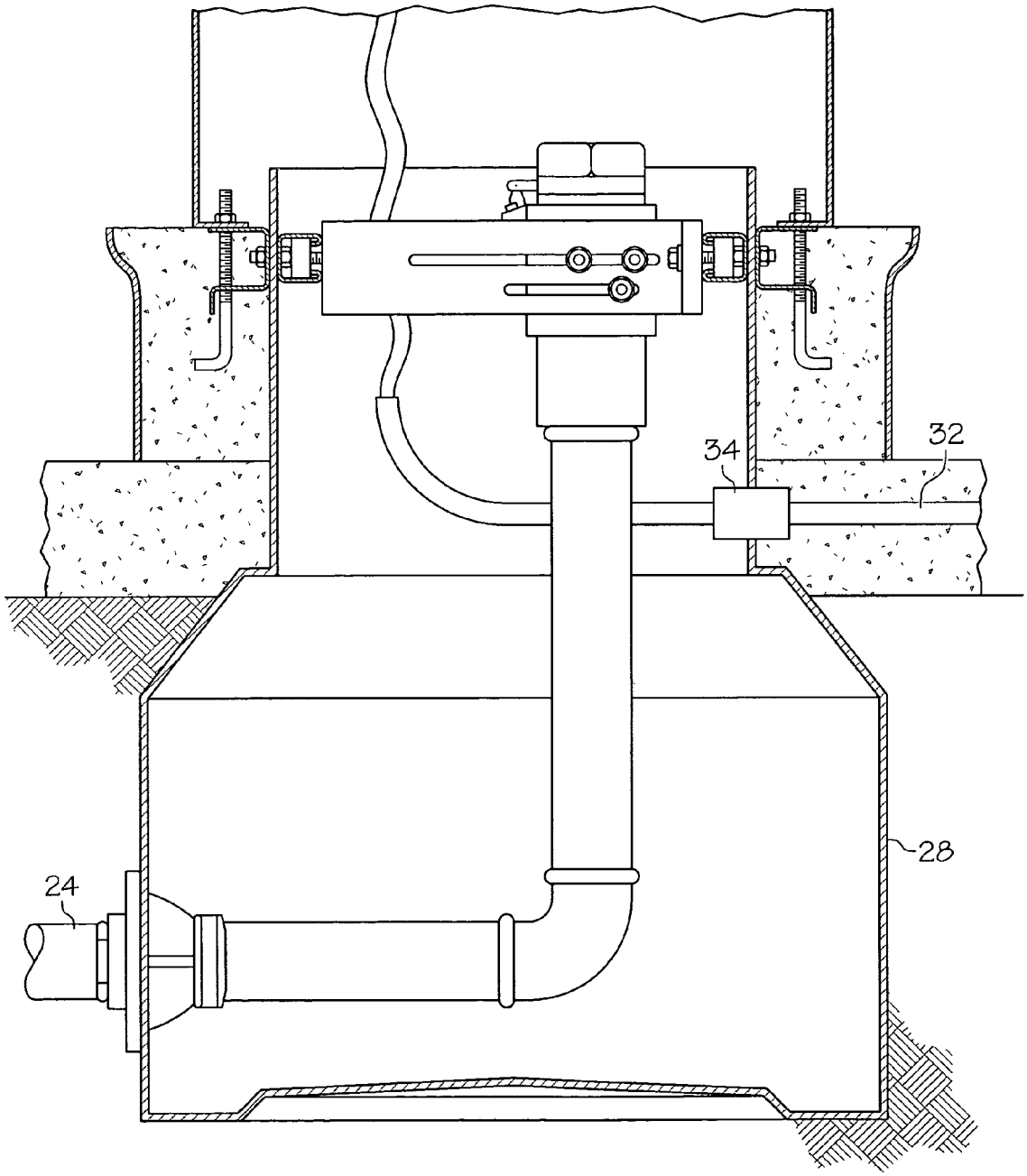
FIG. 2 (PRIOR ART)
FIG. 2 is an enlarged view of a typical prior art sump positioned beneath an above-ground fuel dispenser.

As shown more clearly in FIG. 2, an auxiliary communication line 32 (e.g., which may include electrical wires) can pass through a sidewall of the sump 28 for delivering electrical energy to the pump and/or other electrically powered components disposed within a corresponding above-ground dispensing unit (e.g., fuel dispensing unit 30 shown in FIG. 1). A seal 34 surrounds the auxiliary communication line 32 as it passes through an opening in the sidewall for the purpose of preventing fluid flow through this sidewall opening. Seals such as seal 34 have experienced success in the prior art in sealing sidewall openings from leakage into or out of the sump. Unfortunately, such seals and their installation add cost to the sump 28. Furthermore, such seals are not fully successful at preventing leakage, particularly after the passage of time and exposure of the seal to environmental influences.

Figure 3:
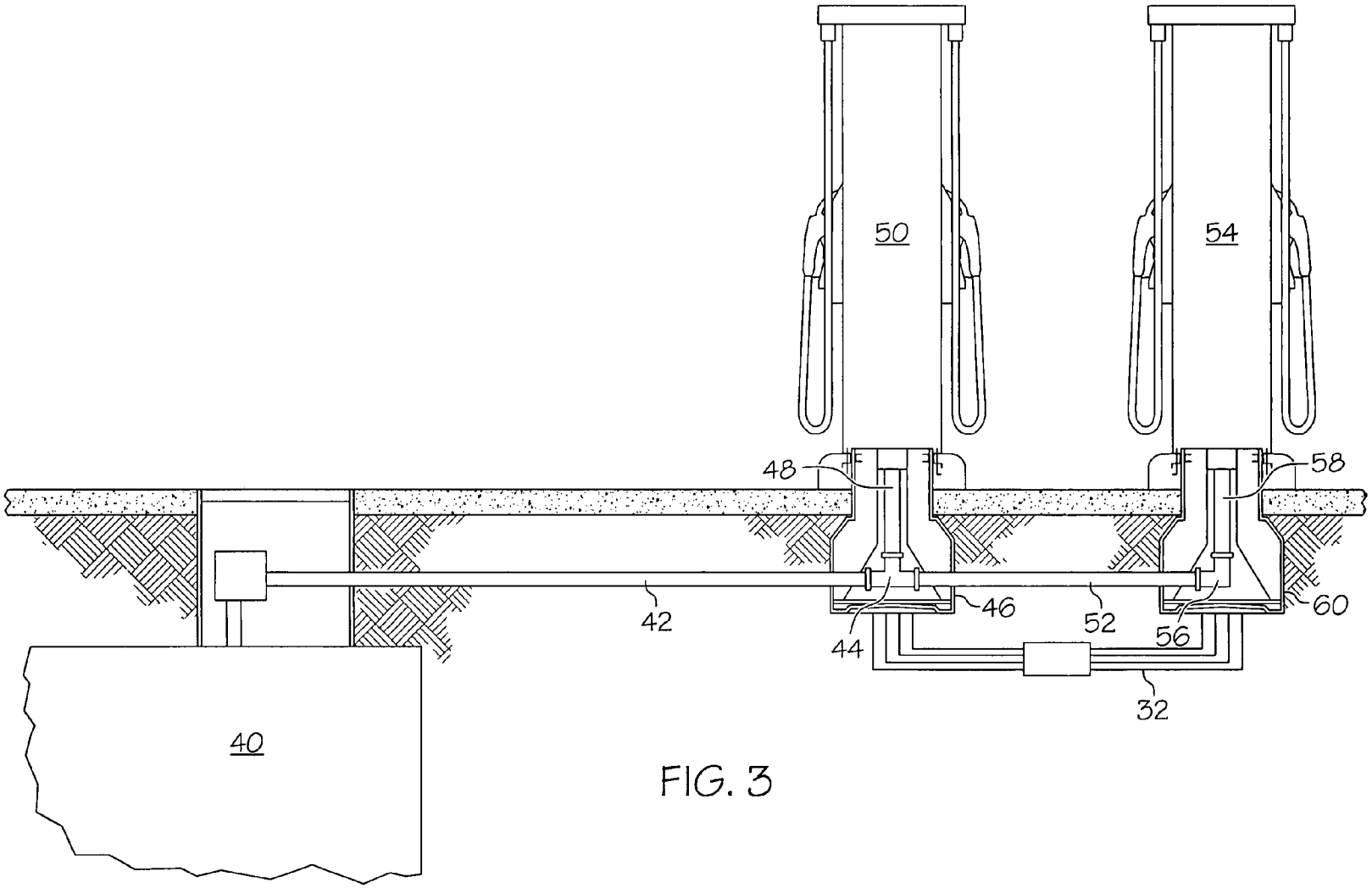
FIG. 3 is a schematic representation of a fluid dispensing network for a fuel dispensing station similar to the depiction of FIG. 1, but showing a sump constructed according to one embodiment of the present invention.

Turning now to FIG. 3, an improved sump/dispenser assembly constructed in accordance with the principles of the present invention is shown. Like the network of pipes depicted in FIG. 1, the network of FIG. 3 includes an underground storage tank 40 from which gasoline or other fluid is pumped and delivered to a delivery pipe 42. The delivery pipe 42 delivers this fluid to a fitting 44 located within a sump 46. Fluid is passed from the fitting 44 to a dispensing unit (e.g., fuel dispensing unit 50) through a riser pipe 48. Fluid is also passed from the fitting 44 through a delivery pipe 52 to a further dispensing unit (e.g., fuel dispensing unit 54) through a fitting 56 and a further riser pipe 58, both which are located in a sump 60.

Figure 4:
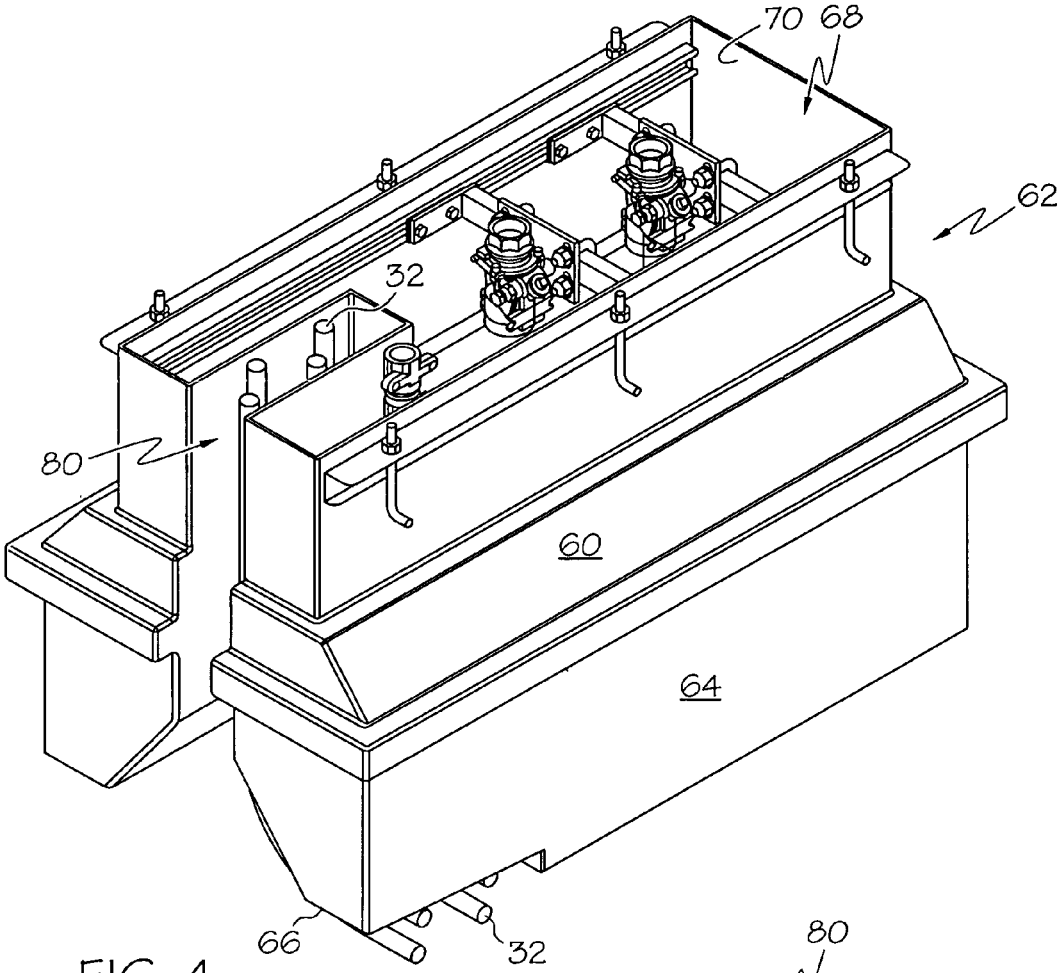
FIG. 4 is an enlarged perspective view of the sump depicted in FIG. 3.

Unlike the prior art sump depicted in FIGS. 1 and 2, the sump of FIG. 3 does not include a sidewall opening for electrical lines or other auxiliary communication lines. One exemplary embodiment of sump 60 is shown in further detail in FIG. 4. It can be seen in FIG. 4 that the sump 60 includes a containment structure, generally designated by the number 62. The containment structure 62 includes a plurality of sidewall structures, collectively referenced by the numeral 64, and a bottom wall structure 66. The bottom and sidewall structures 66, 64 cooperate to define an internal cavity 68 within the containment structure 62 capable of holding a fluid. The specifically illustrated sidewall structures 64 in FIG. 4 are arranged so that the cross-sectional configuration of the containment structure is generally quadrilateral. In the illustrated embodiment, the configuration is generally rectangular.

The sump 60 has an opening 70 proximal to its upper portion and opposite to the bottom wall structure 66. This opening 70, as shown in FIG. 3, can be sized and configured to closely match the size and configuration of the footprint of the fuel dispensing unit 54. Those skilled in the art will readily appreciate that the opening 70 receives drippage from the fluid components within the fuel dispensing unit 54. Since it is imperative that any drippage from the fuel dispensing unit 54 be contained in the sump 60 so that the drippage does not contaminate the ground soil, it is desirable that the drip area defined by the opening 70 fully encompass or at least substantially encompass the entire footprint of the fuel dispensing unit 54.

Figure 5:
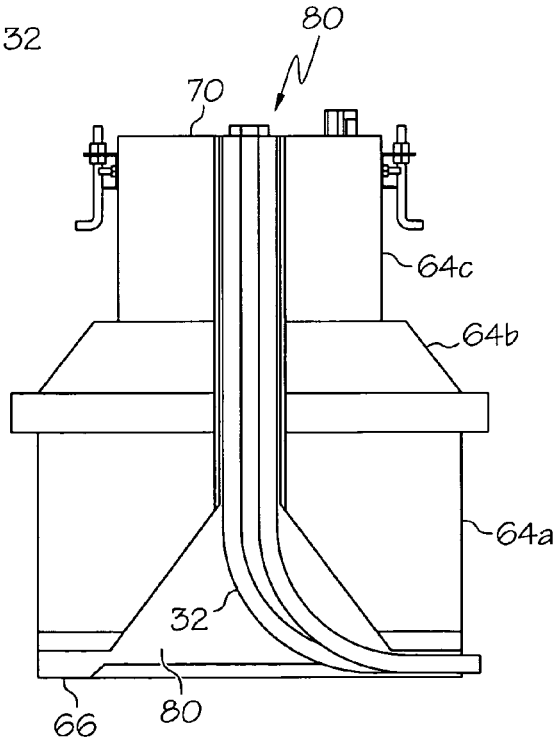
FIG. 5 is an end view of the sump of FIGS. 3 and 4.
Figure 6:
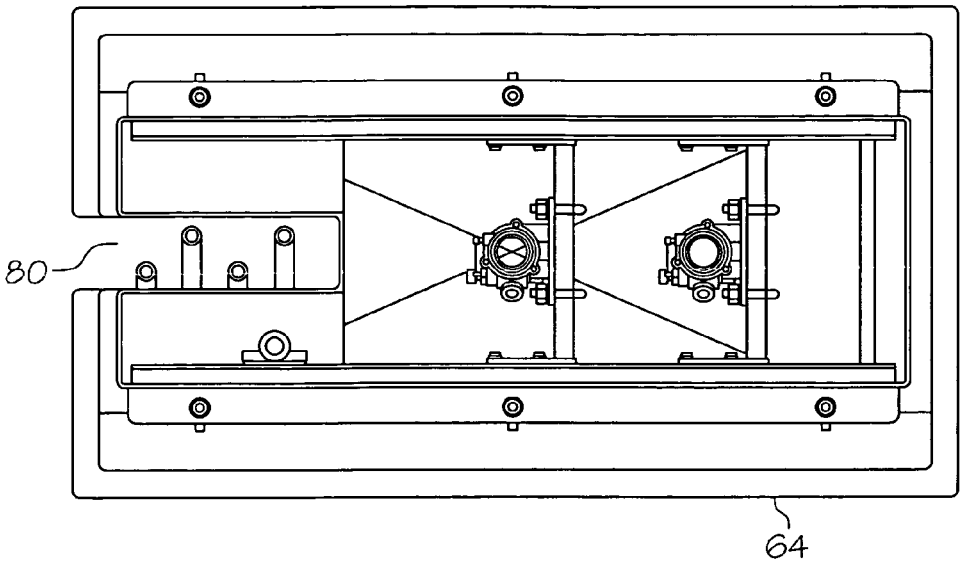
FIG. 6 is top view of the sump of FIGS. 3-5.
Figure 7:
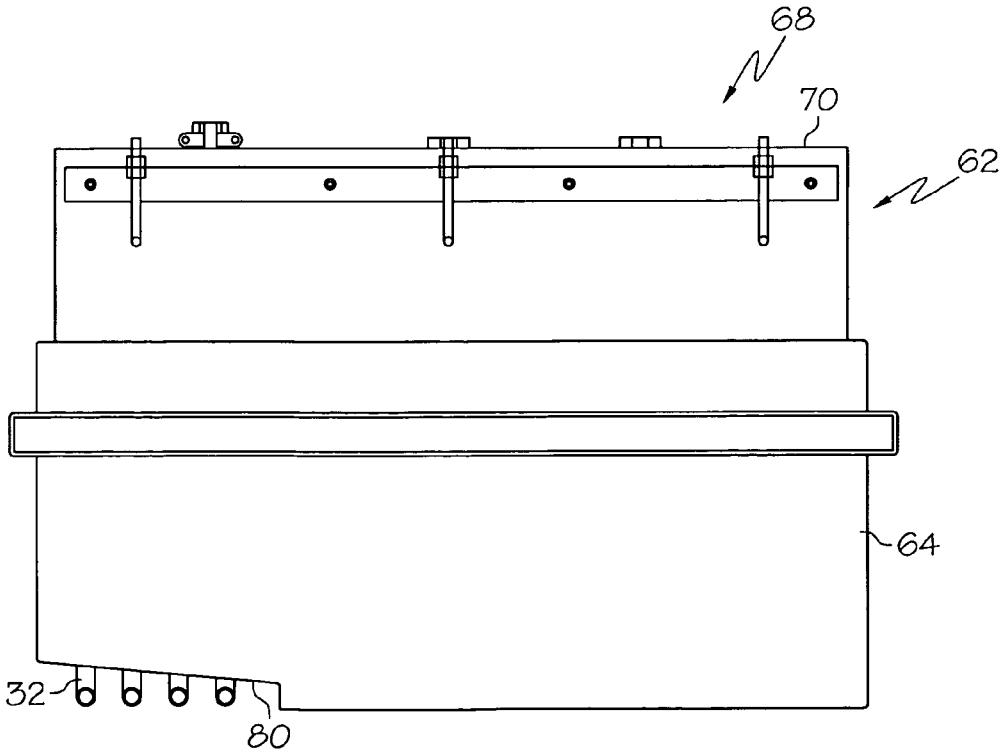
FIG. 7 is a side elevational view of the sump of FIGS. 3-6.

In the specifically illustrated sump 60, as shown best in FIG. 5, the sidewall structures 64 arrange the containment structure 62 into three discrete sections, namely lower section 64*a*, intermediate section 64*b* and upper section 64*c*, all of which are shown to have generally rectangular cross-sectional configurations.

In accordance with the present invention, the sump 60 includes an auxiliary communication line receiving structure for receiving electrical or other auxiliary communication line (s) and for directing the line(s) to a position adjacent to the drip area defined by the opening 70. This is achieved in the specifically illustrated embodiment of the invention through the agency of a passageway 80 extending into a space defined by the containment structure 62. In the specifically illustrated embodiment of FIGS. 4-8, this passageway 80 extends from the bottom wall structure 66 to a position adjacent to the drip opening 70. It will be understood that the passageway 80 can be located and/or configured with regard to the drip opening 70 such that any drippage from the fluid components within a fuel dispensing unit will not enter the passageway 80, but will rather be directed into the drip opening 70. In this illustrated embodiment, the passageway 80 is formed by an open-sided recess in one or more of the sidewall structures 64. As shown, the passageway 80 has a generally quadrilateral configuration, specifically a rectangular configuration that includes an open side extending to the exterior of the containment structure 62. The passageway 80 is isolated from the internal cavity 68 defined by the bottom and sidewall structures 66 and 64. As shown in FIG. 5, the passageway 80 permits electrical and/or other auxiliary communication lines 32 (e.g., for powering components within the fuel dispensing unit 54) to be delivered to the area beneath the footprint of the dispensing unit 54 without the necessity of penetrating any of the sidewall or bottom structures 64, 66 of the containment structure 62.

Figure 8:
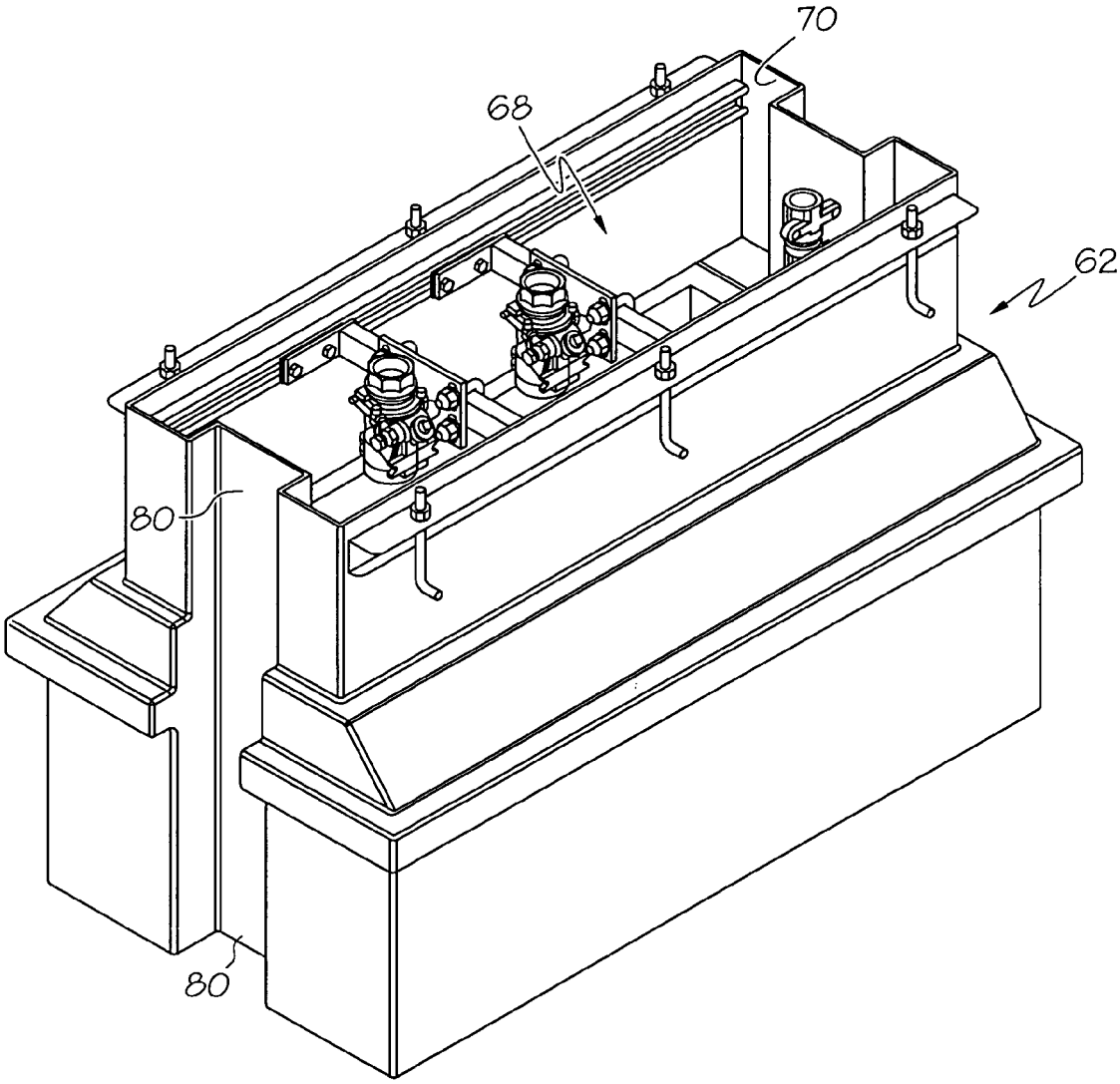
FIG. 8 is a perspective view of an alternative embodiment of a sump constructed in accordance with the principles of the present invention.

In the embodiment depicted in FIGS. 4-7, the passageway 80 has a configuration that converges as it extends from the bottom to the top of the containment structure 62. This configuration allows gradual bending of the communication lines. Another embodiment having a passageway 80 without a converging configuration is shown in FIG. 8. Like the passageway 80 in the embodiments of FIGS. 4-7, the passageway 80 in FIG. 8 is formed by an open-sided recess of rectangular cross-sectional configuration in the sidewall structure 64. Unlike the passageway 80 of FIGS. 4-7, however, the cross-sectional configuration of the passageway 80 in FIG. 8 is substantially constant as the passageway 80 extends from the bottom structure 66 to a position adjacent to the drip area defined by the opening 70.

Figure 9:
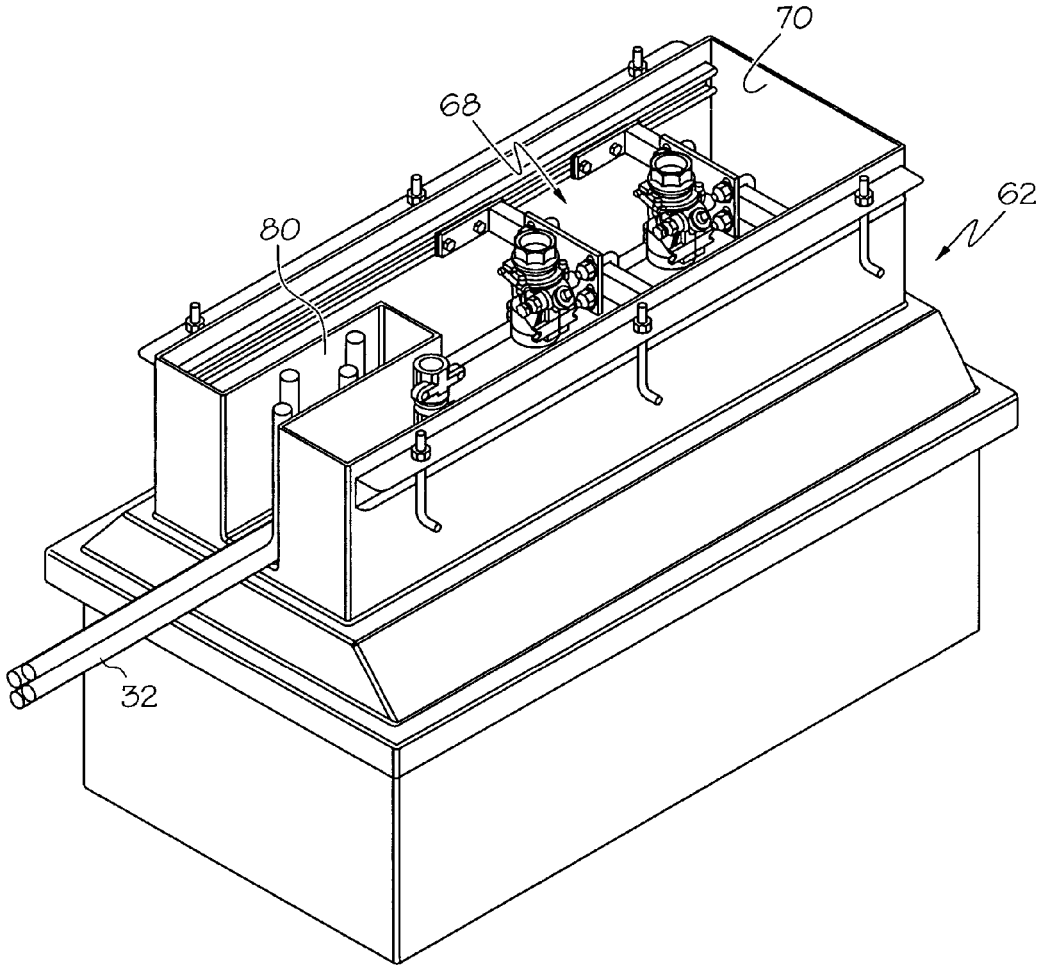
FIG. 9 is a perspective view of a further embodiment of a sump constructed in accordance with the principles of the present invention.

FIG. 9 shows a further embodiment similar to the embodiment of FIG. 8 in that the passageway 80 has a generally constant cross-sectional configuration and extends to a position adjacent to the drip area defined by the opening 70 for delivering electrical and/or other auxiliary communication lines beneath the footprint of the fuel dispensing unit 54. It differs from the embodiment of FIG. 8 in that the passageway 80 in FIG. 9 does not extend to the bottom wall structure 66. Instead, it this latter embodiment, electrical and/or other auxiliary communication lines enter the space defined by the containment structure 62 at a location intermediate the bottom wall structure 66 and the drip opening 70.

Figure 10:
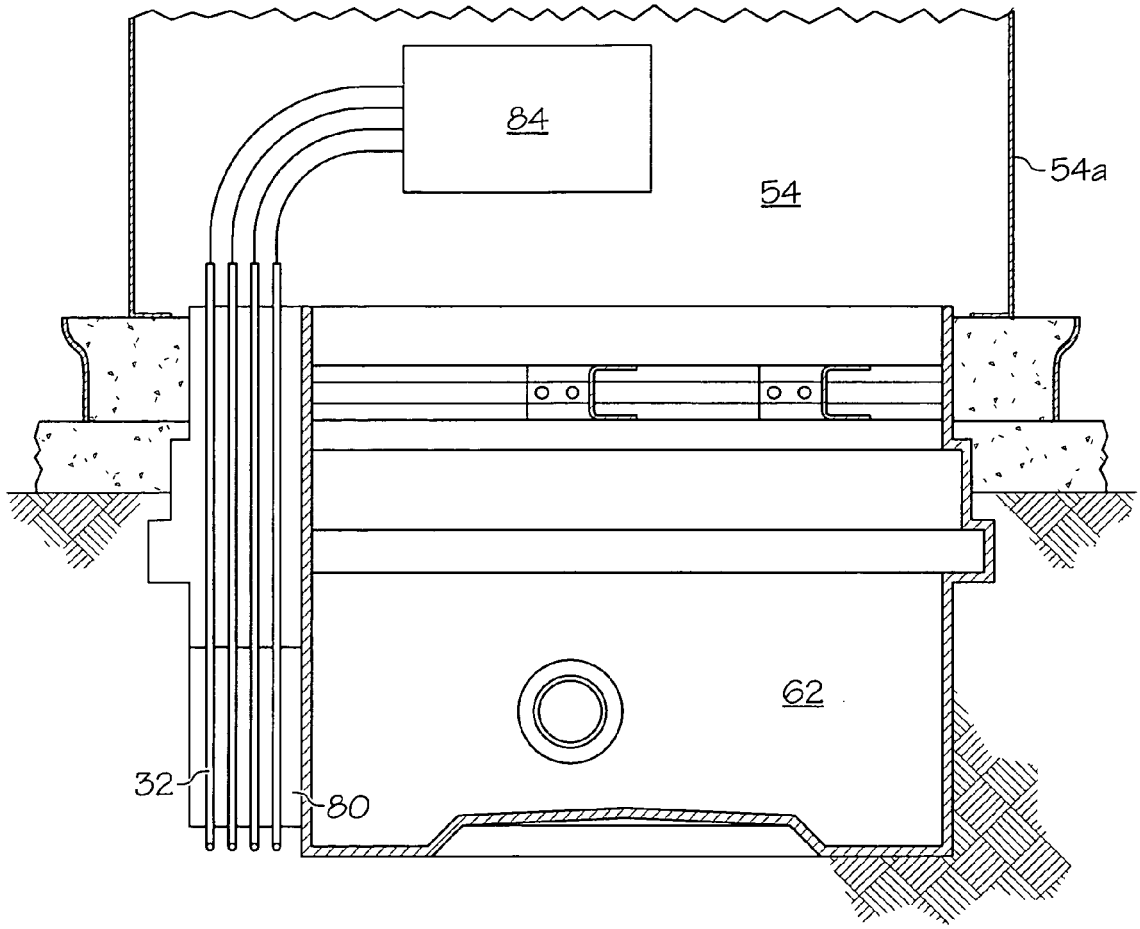
FIG. 10 is a schematic side elevational view of a sump constructed in accordance with the principles of the present invention and depicting the opening of the sump disposed beneath the footprint of an above-ground dispensing unit.

FIG. 10 depicts the sump 62 disposed beneath the footprint of the fuel dispensing unit 54, and further shows the electrical lines 32 being directed through the passageway 80 and to a liquid fuel dispensing component 84 within the fuel dispensing unit 54. The footprint of the fuel dispensing unit 54 is shown to be generally defined by an outer shell 54*a* of the fuel dispensing unit 54.

The specific illustrations and embodiments described herein are exemplary only in nature and are not intended to be limiting of the invention defined by the claims. Further embodiments and examples will be apparent to one of ordinary skill in the art in view of this specification and are within the scope of the claimed invention.

What is claimed is:

1. A dispenser sump adapted for placement beneath a fluid handling component, comprising:

a containment structure, the containment structure including a bottom wall structure and at least one sidewall structure, the bottom and the at least one sidewall structures cooperating to define an internal cavity within the containment structure capable of holding a fluid, the sidewall structure further defining a drip opening opposite the bottom wall structure, the drip opening defining a predetermined drip area for receiving fluid drippage, the drip opening being adapted for placement beneath a footprint of a fluid handling component;

a passageway extending into space defined by the containment structure and exiting adjacent to the drip area defined by the drip opening, the passageway being isolated from the internal cavity and adapted to receive and direct auxiliary communications lines beneath the footprint of a fluid handling component;

wherein the passageway is formed by a recess in at least one sidewall of the containment structure that extends vertically from a position below the drip opening into the drip opening, and wherein the recess forming the passageway includes a vertically extending open side extending to an exterior of the containment structure.

2. A dispenser sump as recited in claim 1 wherein the drip area and the recess extending into the drip area each have generally quadrilateral configurations.

3. A dispenser sump as recited in claim 1 wherein the passageway extends vertically from the bottom wall structure to a position adjacent to the drip opening.

4. A dispenser sump as recited in claim 1 wherein the predetermined drip area has a generally rectangular configuration.

5. A dispenser sump as recited in claim 1 wherein the passageway extends from a position adjacent to the opening but does not extend to the bottom wall structure.

6. A dispenser assembly, comprising:

a liquid fluid dispenser, including a housing, the housing having an interior area and a footprint with a predetermined size and configuration; and at least one liquid dispenser component disposed within the interior area of the housing; and a dispensing sump disposed beneath the housing, the dispensing sump including:

a containment structure, the containment structure including a bottom wall structure and at least one sidewall structure, the bottom and the at least one sidewall structures cooperating to define an internal cavity within the containment structure capable of holding a fluid, the at least one sidewall structure further defining a drip opening opposite the bottom wall structure, the drip opening defining a drip area sized and configured in correspondency to the footprint of the housing, the drip opening being disposed beneath the housing footprint and being operative to receive drippage from the at least one liquid dispenser component;

a passageway extending into space defined by the containment structure and exiting adjacent to the drip area defined by the opening, the passageway being isolated from the internal cavity of the containment structure; and at least one auxiliary communication line extending through the passageway, the at least one auxiliary communication line exiting the containment structure and extending from beneath the footprint of the housing to the at least one liquid dispenser component;

wherein the passageway is formed by a recess in the at least one sidewall of the containment structure that extends vertically from a position below the drip opening into the drip opening, and wherein the recess forming the passageway includes a vertically extending open side extending to an exterior of the containment structure.

7. A dispenser assembly as recited in claim 6 wherein the footprint of the housing and the opening defining the drip area have matching quadrilateral configurations and sizes.

8. A dispenser assembly as recited in claim 6 wherein the drip area and the recess extending into the drip area each have generally rectangular configurations.

9. A dispenser assembly as recited in claim 6 wherein the passageway extends vertically from the bottom wall structure to a position adjacent to the drip opening.

10. A dispenser assembly as recited in claim 6 wherein the passageway extends from a position adjacent to the opening but does not extend to the bottom wall structure.

11. A dispenser sump adapted to accommodate auxiliary communication lines, the dispenser sump comprising:

a containment structure, the containment structure including a bottom wall structure and at least one sidewall structure, the bottom and the at least one sidewall structures cooperating to define an internal cavity within the containment structure capable of holding a fluid, the sidewall structure further defining a drip opening opposite the bottom wall structure, the drip opening defining a predetermined drip area for receiving fluid drippage, the drip opening being adapted for placement beneath a footprint of a fluid handling component; and an auxiliary communication line receiving structure disposed proximally to the drip opening, the receiving structure being adapted to receive an auxiliary communication line located external to the containment structure and to direct an auxiliary communication line to a position adjacent to the drip area;

wherein the auxiliary communication line receiving structure comprises a recess formed in the at least one sidewall of the containment structure with a vertically extending open side extending to an exterior of the containment structure.

* * * * *